United States Patent [19]

Heintz

[11] 4,398,746

[45] Aug. 16, 1983

[54] ADJUSTABLE WAXLESS SKI BASE

[76] Inventor: Gary R. Heintz, 4919 S. Eastlake Dr. #22G, Murray, Utah 84107

[21] Appl. No.: 224,276

[22] Filed: Jan. 12, 1981

[51] Int. Cl.[3] ..... A63C 7/10

[52] U.S. Cl. ..... 280/604

[58] Field of Search ..... 280/604, 605, 809

[56] References Cited

U.S. PATENT DOCUMENTS

| | | | |
|---|---|---|---|
| 1,989,377 | 1/1935 | Osborn | 280/604 |
| 2,248,008 | 7/1941 | Miesen | 280/604 |
| 2,844,380 | 7/1958 | Tribelhorn | 280/604 |
| 3,927,896 | 12/1975 | Detoia | 280/604 |

FOREIGN PATENT DOCUMENTS

| | | | |
|---|---|---|---|
| 2615196 | 10/1976 | Fed. Rep. of Germany | 280/604 |
| 219054 | 5/1942 | Switzerland | 280/604 |
| 439042 | 12/1967 | Switzerland | 280/604 |

*Primary Examiner*—Joseph F. Peters, Jr.
*Assistant Examiner*—Mitchell J. Hill
*Attorney, Agent, or Firm*—Thorpe, North & Western

[57] ABSTRACT

A waxless or gripping ski base capable of continuous adjustment from a flat-base glide configuration to a stepped-base grip configuration for increased traction, such as may be desired in cross-country skiing. The ski base comprises a plurality of base segments which are pivotally attached to a support member and are subject to adjustment from the flat glide configuration into a variety of nonlinear gripping configurations. This variety of stepped-base gripping configurations is programmed by selection of a unique geometric configuration for displacement contact faces which operate against the base segments to cause their vertical displacement in either a positive or negative direction. The segment adjustment member can be selectively changed to cause the contact faces to displace the segments out of the base line of the ski into a traction configuration which may be either convex or fully extended as in a sawtooth pattern. Likewise, the adjustment member may be used to develop a negative displacement for improved traction of the ski in a downhill path.

32 Claims, 14 Drawing Figures

ADJUSTABLE WAXLESS SKI BASE

BACKGROUND OF THE INVENTION

1. Field of the Invention

The present invention relates to a traction device for a ski base to enable greater control at a snow surface. Specifically, the invention pertains to a waxless ski base useful on cross-country skis and related winter sports equipment.

2. Prior Art

Like many forms of sport activity, cross-country skiing has now developed an individual identity as a sport requiring its own form of unique equipment and training. Although any ski could be used in cross-country activity, recent years have seen the development of a "waxless ski base" which is specifically adapted to enhance the traction of this ski base.

Cross-country skiing differs from down-hill skiing in that the participant frequently must navigate all types of terrain, including level and uphill grades. Obviously, some traction is desirable so that the skier can literally walk up a hill without removing his skis. Furthermore, in traversing level grades, the cross-country skier utilizes a "kicking" technique in which the skier pushes off against traction developed by the ski base of the cross-country ski.

Typically, this traction section of the ski base is referred to as the "kicking zone" and is located in the waist or midportion of the ski. Numerous methods have been applied to develop a traction configuration for use in the kicking zone. An example of such a device is illustrated in U.S. Pat. No. 1,989,377 by Osborn which shows a strip of material having a plurality of folds designed to engage the ski surface and operate as an attachable traction device.

Several mechanical equivalents have been developed since the osborn patent to accomplish the same objective. U.S. Pat. No. 3,927,896 and Swiss Pat. No. 253,733 disclose skis with cleat devices which operate to project below the surface of the ski to retard movement. Additional Swiss patents which have provided a more sophisticated mechanical approach to this problem include 213,007 and 340,748. The latter Swiss patents combine this traction surface as an integral part of the ski, with the capacity of adjusting into or out of a traction mode.

The Swiss 340,748 patent teches a ski base which can be modified from a flat configuration to a stepped configuration; however, there is little adjustability or variation to the projection pattern between the in and out adjustments. Furthermore, each traction pad is displaced an equal distance from the base of the ski such that the traction portion of the ski is a linear-type projection.

The Swiss 213,007 patent discloses a ski base cleat system which is not adjustable into a flat or glide base surface mode. Instead, the cleats are projected out of the base line in a convex displacement pattern in accordance with the displacement of a rubber strip which has the cleats attached thereto. This is displaced by a finger which can be rotated outward through the ski to place the cleats below the base line and thereby subject any rearward glide to the traction of such cleats.

Finally, the modern trend in cross-country skis is to premold a base with a permanent nonlinear gripping surface such as the Fishscale NOWAX ski marketed by TRAK. The base of this "fishscale" ski has a molded plastic configuration which resembles the scales of a fish and includes gliding surfaces which are slightly inclined away from the base to form a gripping or kicking edge toward the rear of the scale.

These various cross-country ski configurations each provide one or more benefits to the skier who desires improved traction for negotiation of hills or level terrain. However, none of these skis provide the versatility to permit the skier a broad range of adjustment from a flat-base configuration which operates similar to a down-hill ski, to a variety of cleat projections which are adapted for various snow and terrain conditions. This need of adjustment versatility is particularly critical in cross-country skiing because the cross-country skier does not restrict himself to a well groomed ski area which has had trees and other obstacles removed. To the contrary, the cross-country skier must be able to negotiate wilderness areas through forests and over snow which is unpacked and whose condition will vary during the course of a single day. Therefore, the variety of skiing conditions cannot be compared to a typical ski resort whose downhill terrain has been cleared and groomed, and whose snow condition is packed and controlled.

For example, the cross-country skier may start in the early morning and ski a crusted snow which requires a specific type of base adjustment. As the day progresses, those areas of snow exposed to the sunlight will soften, requiring a different base adjustment. In the forest areas, however, the crust may remain due to shading of the trees. Further adjustment may be desired where the cross-country skier negotiates deep powder as opposed to hard packed snow conditions.

In addition to these variety of snow conditions, adjustment versatility for the base of the cross-country ski is further required where the skier is a beginner versus an expert, or when the skiing is to be informal and leisurely as opposed to high performance competition.

To date, the prior art has simply not provided a ski whose versatility meets the demand of a broad spectrum of changing conditions. What is needed, therefore, is a single ski adapted for specific adjustment to unique conditions typically encountered by the cross-country skier.

SUMMARY AND OBJECTS OF THE INVENTION

It is therefore an object of the present invention to provide a ski base which can be adjusted to develop friction in one or both directions of travel wherein the degree of friction and configuration of the ski base can be varied to satisfy the specific changing weather and snow conditions, as well as give variety to the ski performance characteristics.

It is also an object of the present invention to provide a waxless ski base capable of adjustment from a flat glide configuration to a plurality of grip configurations.

It is a further object of the present invention to provide such a waxless ski base which is capable of adjustment to either a linear or nonlinear displacement pattern, at the discretion of the skier.

It is a still further object of this invention to provide a waxless ski base capable of adjustment from the flat glide configuration into a negative displacement pattern, creating resistance to forward movement of the ski when in a downhill movement path.

It is a still further object of the present invention to provide such a waxless ski base capable of attachment to an existing ski or other type of sports equipment such as toboggan or sled.

These and other objects of the present invention are realized in a waxless ski base which includes an elongated support member and a plurality of base segments which are individually mounted to the support member by pivotal attachment means. Each base segment consists of a planar glide face, a contiguous gripping face and a displacement contact face on the opposite side from said glide face to permit the vertical displacement of the base segment into a gripping or traction configuration. A segment adjustment member is disposed between the support member and the base segments and operates to control the displacement pattern of the base segments. This adjustment member includes a plurality of displacement faces which have differing programmed geometric configurations disposed in contact respectively with said segment displacement contact faces. Finally, means are provided in combination with the previously described structure for selectively changing the location of contact of the segment contact faces along the respective programmed geometric configurations of the segment displacement faces. This selective changing of location operates to vary the degree of projection of one or more of the segments with respect to the flat-base glide configuration.

The inventive structure set forth herein develops new versatility and control for the cross-country skier in a single, adjustable waxless ski base. In downhill terrain, a skier can adjust his ski base to a flat-guide configuration which offers no resistance to increased speed over the snow surface. If, however, there is a need for reduced speed in a downhill path, the skier may simply make an adjustment to the waxless ski base to develop a forward traction which operates to reduce the ski speed to whatever degree desired.

Where the terrain changes to level or uphill grade, the skier may adjust the same waxless ski base to a positive displacement pattern. For level ground, the skier may select a slightly projecting convex segment projection which provides moderate traction while retaining favorable glide characteristics to maintain speed following the kicking phase of each stride. Finally, where the skier encounters a steep grade, the waxless ski base can be fully adjusted into a sawtooth or maximum gripping pattern to permit the skier to walk up the hill without inadvertently sliding backwards.

The need for such versatility arises from the variety of weather conditions which affect the speed of the snow, as well as the variations in terrain which must be navigated by the cross-country skier. Furthermore, such a skier does not want to be burdened with carrying various types of equipment to modify his skis to realize an optimum skiing condition. The present invention can meet the requirements of all such conditions in a single, adjustable waxless ski base which may be an integral part of a cross-country ski or in an attachable configuration for use in connection with skis or other snow-type equipment.

DETAILED DESCRIPTION OF THE INVENTION

Referring now to the drawings

Figure 1:
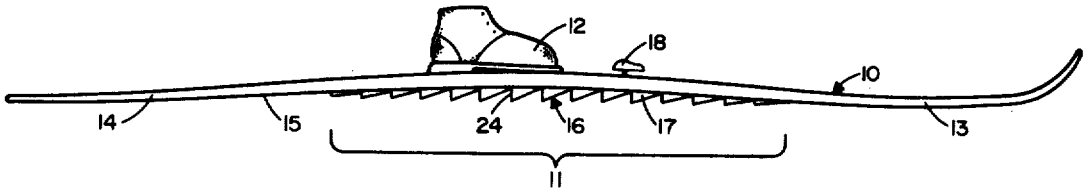
FIG. 1 illustrates a side view of a ski having a waxless ski base integrally formed therewith in accordance with the teachings of the subject invention.

FIG. 1 illustrates the primary utility of the subject invention as an integral part of a cross-country ski. This ski 10 includes a waist or midportion 11 located under the skiers foot 12, between the forward 13 and rearward 14 parts of the ski 10. FIG. 1 discloses a ski with a slight camber or arch in the waist 11 section to facilitate uniform distribution of weight across the base surface 15 of the ski. Without such camber, the weight of the skier would be substantially concentrated in the waist section 11.

The present invention provides an improved structure preferably mounted along the base 15 of the ski in the waist 11 section thereof. This consists of a waxless ski base 16 which is structured to facilitate operation of the waist section 11 as a kicking zone for the cross-country ski. The kicking zone is that portion of the ski base under the foot of the skier which is characterized by a traction or waxless surface which is the product of a nonplanar structure such as illustrated in FIG. 1. As used herein, "waxless" refers to a ski base which can develop traction for cross-country type skiing as a result of this nonplanar structure and without the need for application of any wax. This nonplanar structure shall be generally referred to herein as a "stepped-base grip configuration."

In FIG. 1, the waxless ski base 16 includes a plurality of base segments 17 which project downward from the ski base 15. Under the concepts of the present invention, these base segments 16 are adjustable without removing the ski by use of an adjustment means or knob 18 which can displace the segments from a flat-base glide configuration to a nonlinear stepped configuration as illustrated in FIG. 1. When adjusted to the flat-base configuration, the ski resembles a conventional down-hill ski in that the base 15 would be flat in structure for the purpose of maximizing glide. This structure would be utilized by a cross-country skier when a down-hill terrain is being traveled.

As the skier encounters cross-country flat or uphill terrain, the ski could be adjusted to the configuration illustrated in FIG. 1 to provide traction in the kicking zone or waist section 11 as desired. Although a stepped-base configuration has been applied to cross-country skis to provide the recited benefits, the present invention discloses a more versatile waxless ski base capable of continuous adjustment from a flat-base glide configuration to a stepped-base grip configuration.

Figure 2:
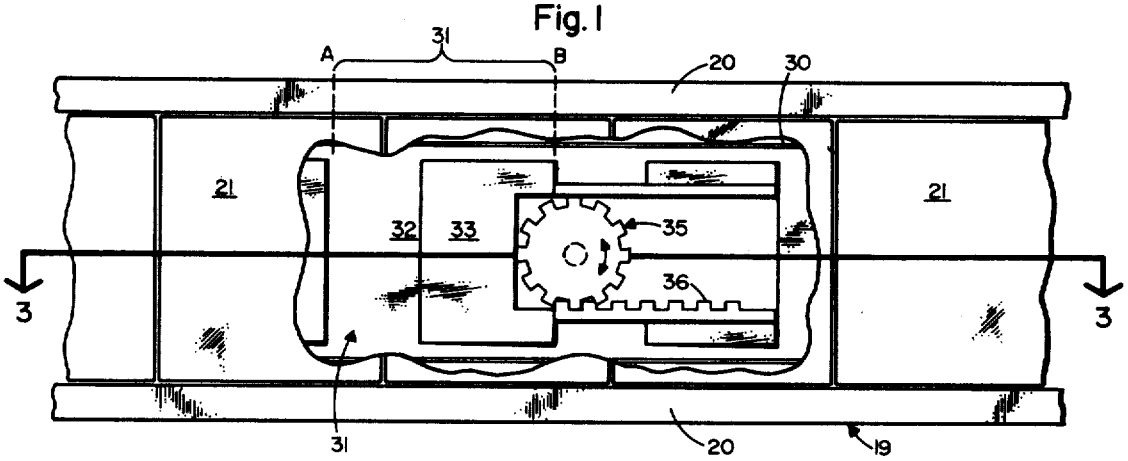
FIG. 2 is a partially cut away bottom view of the subject waxless ski base, showing its inner core and adjustment mechanism.
Figure 3:
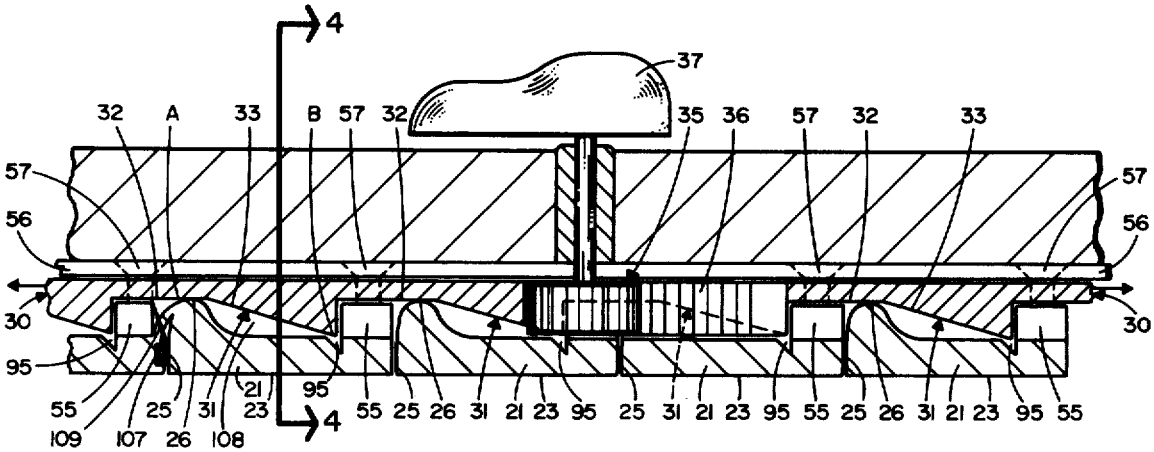
FIG. 3 is a cross-section taken along the lines 3—3 of FIG. 2.
Figure 4:
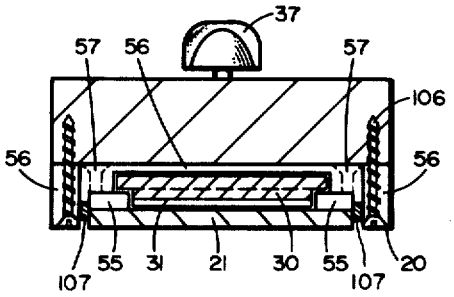
FIG. 4 is a cross section taken along the lines 4—4 of FIG. 3.

FIGS. 2, 3 and 4 illustrate one embodiment of this continuous adjustable ski base when in the flat base glide configuration. As illustrated in FIG. 2, the bottom view of the waxless ski base 19 includes continuous base edge sections 20 laterally disposed as an encasement for a plurality of base segments 21 whose glide surface conforms to the glide surface of the continuous base edge sections 20 when the ski base is adjusted to a flat-base glide configuration.

This flat-base glide configuration is more clearly demonstrated in the side view of FIG. 3 which shows the base segments 21 coupled and aligned along the bottom of the ski base structure to form the contacting surface of the ski base with the snow.

These base segments include a planar glide face 23 which is the primary snow-contacting surface when the ski base is adjusted to a flat glide configuration. This glide face may be constructed of numerous materials, including plastics and surfaces typically applied as ski base material.

The base segments also include a contiguous gripping face 24 (FIG. 1) which provides traction when the waxless ski base is adjusted to the stepped-base grip configuration. In FIG. 3, this grip face would be the rearward segment face 25 when the segment 21 is displaced downward, exposing the grip face 25.

The downward adjustment of each segment 21 is accomplished by a downward force applied at a segment displacement contact face 26 which is on the opposite side from the glide face 23. Although the illustrated segment contact face 26 is configured as a projecting lip from the segment 21, other contact configurations are contemplated and may be equally as effective.

The force applied at the contact face 26 of each segment 21 is developed by physical contact with a segment adjustment member 30. This segment adjustment member 30 includes a plurality of displacement faces 31 which have differing programmed geometric configurations for contacting the respective segment contact faces 26 and forcing them into a displacement pattern which is programmed by the various geometries 31 as referenced. The length of each displacement face 31 approximately conforms to the length of each segment and depends upon the specific nature of the segment adjustment member 30. For example, the embodiment of FIGS. 2 and 3 illustrates a reciprocating segment adjustment member 30 which traverses a tracking distance corresponding to the displacement face whose tracking distance begins at A and ends at B. Therefore, the segment contact face 26 is limited to reciprocating movement between these respective points A and B. It should be noted that although the reciprocating distance will be the same for any point on the segment adjustment member, the geometries of the displacement faces 31 which are in contact with the segments 21 will vary along the length of the segment adjustment member 30. This variation provides a nonuniform displacement pattern to the segments as illustrated by the projection pattern of FIG. 1.

Many geometries can be structured to implement the inventive aspects of the subject waxless ski base. The specific geometry disclosed in FIGS. 2 and 3 is a combination of flat planar sections 32 and ramp sections 33 which cooperate to selectively displace and stabilize the segment 21 to a desired location with respect to the continuous base section 20. To facilitate the use of a variety of geometries, the segment adjustment member 30 may be removable so that another adjustment member of different geometry can be inserted. With this system the same set base segments can be subject to any displacement pattern merely by inserting an appropriate segment adjustment member 30.

Specifically, the base segments 21 are displaced to an appropriate pattern by movement of the segment adjustment member 30 along its reciprocating path. This movement is developed by a gear mechanism 35 which drives a reciprocating gear plate 36 attached to the segment adjustment member. Therefore, as the gear mechanism 35 is rotated by an adjustment knob 37, the gear plate 36 is forced in a transverse direction, thereby driving the segment adjustment member along the same direction. It is also clear to one skilled in the art that numerous methods of reciprocation of 30 may also be applied such as pullies, multiple gears, notches or levers to achieve the same effect.

As the segment adjustment member 30 is forced to the left of the page as represented on FIG. 3, the segment contact face 26 tracks along the displacement face 31 of the adjustment member. It is apparent, that the relative orientation of the segment glide face 23 will be determined by the geometric configuration of the displacement face 31. In FIG. 3, the continued movement of the segment adjustment member toward the left side of the page will result in displacement of each segment in a downward direction at a displacement rate and distance as dictated by the angle of inclination of the ramp section 33 on each respective displacement face 31. When the adjustment member 30 has been fully displaced to the left, segments 21 will be in their fully extended position. By returning the adjustment knob 37 to its original position, the segment adjustment member 30 reciprocates toward the right of the page, resulting in a return of the segments to their flat-base configuration against the planar section 32 of the displacement face 31. During actual operation, the force which maintains the contact of the displacement contact face 26 at the displacement face 31 is the weight of the skier carried through the ski to the glide face 23 of each base segment 21.

Figure 6:
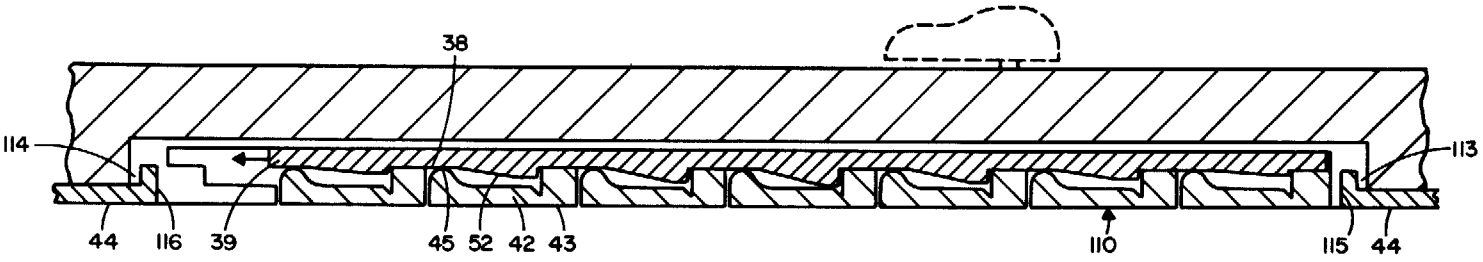
FIG. 6 is a graphic representation of components of the waxless ski base having a flat-base glide configuration.
Figure 7:
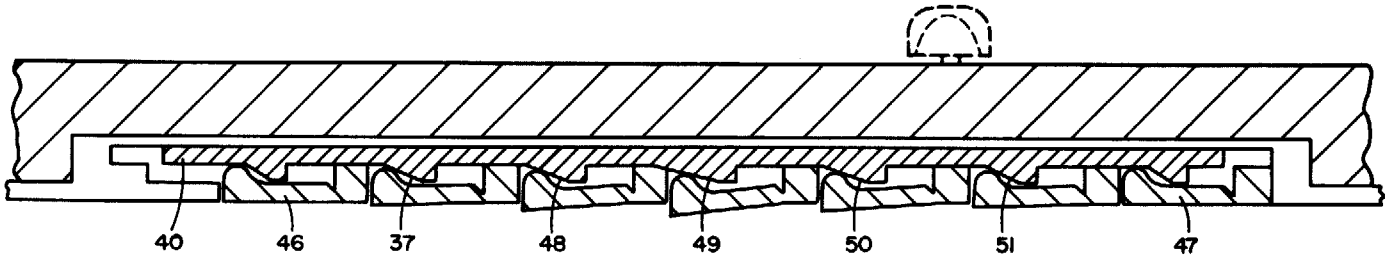
FIG. 7 discloses a graphic representation of components of the waxless ski base wherein the base segments are subject to a moderate displacement in a convex projection pattern.
Figure 8:
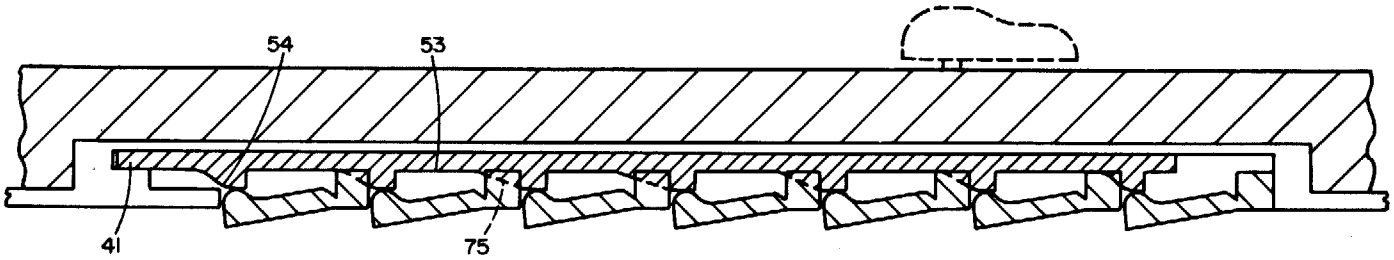
FIG. 8 shows a graphic representation of the components of the subject invention with the base segments fully extended for maximum traction.

Three relative displacement positions of the segments are illustrated in FIGS. 6, 7 and 8. Although the geometries of the respective displacement faces 31, 52, 37 and 75 differ, their general function remains the same. The illustration of FIGS. 6, 7 and 8 demonstrate the relative displacement that occurs as the segment adjustment member 39, 40 or 41 is reciprocated along its track. The three different geometries shown are merely exemplary of the many possible variations available.

FIG. 6 represents the flat-base configuration in which each segment 42 has its planar glide face 43 in approximately the same plane as the ski base 44. In this position, contact occurs at each respective segment contact face 45 at flat planar sections 38 of each respective displacement face 52. It should be noted that in the embodiment of FIG. 6, the respective flat planar sections 38 are substantially equal in length. Therefore, these planar sections 38 do not contribute to a variation in the geometric projection pattern of the segments 42. Instead, segment displacement is a function of the differing angles of inclination which are formed by the respective ramp sections 52. In the case of FIG. 6, these ramp sections have larger angles of inclination toward the center of the ski base to develop a convex projection pattern when the segment adjustment member 39 is fully displaced to the left in the figure.

FIG. 7 graphically illustrates a midway adjustment point of the segment adjustment member 40 along its reciprocating path. In this instance, segments 46 and 47 remain in a flat-base configuration with their respective contact faces at planar sections of the respective displacement faces. The remaining segments have been displaced to various distances, depending upon the angle of inclination of the respective planar ramps 37, 48, 49, 50 and 51. It should be noted that the programmed geometric configuration of the displacement faces in this case are such that maximum displacement initially occurs toward the central portion of the waxless ski base, represented by displacement face 49. This convex pattern of displacement is preferable in view of maximum weight being typically applied at this location during a kick movement by the skier. This particular midway adjustment would be beneficial when the ski terrain is generally flat. In such flat terrain, a cross-country skier needs to obtain the smooth glide movement which is facilitated by a flat-base configuration, whereas some kicking traction is needed to maintain speed. The amount of kicking traction can be selectively adjusted to the medial position of FIG. 7 or to other intermediate positions between the configuration illustrated in FIGS. 6 and 8.

FIG. 8 illustrates the fully displaced configuration of segments, wherein the segment adjustment member 41 has fully traversed its reciprocating track. It will be noted that each of the segments in FIG. 8 have traversed the flat planar sections 53 and ramp sections 54 of the adjustment member 41 and now rest at the maximum displacement position. It will be apparent also that this maximum displacement position could likewise have a convex displacement pattern, or other geometries, depending upon the specific geometric configuration selected for the respective flat planar and ramp sections 53 and 54. As a further example of geometric varieties available for such displacement faces, FIG. 8 illustrates a ramp which is nonplanar in configuration. It will be apparent from this description that the geometries represented by FIGS. 6, 7 and 8 are merely illustrative of the types of geometries which may be interchanged and combined to develop other projection patterns.

In FIGS. 2, 3 and 4, a bottom view of the ramp illustrates a ramp configuration as contacted by the segment contact face 26. In FIG. 2, the displacement face (referenced by the distance 31) includes two surface areas consisting of the flat planar section 32 and ramp section 33. It should be noted that the width of the ramp section 33 is less than the width of each segment 21. The smaller width of ramp 33 permits its travel between mounting studs 55 which provide means for independent pivotal attachment of ease base segment to a support member 56. The support member 56 provides a rigid structure to which each of the respective segments 21 can be attached in the illustrated heel-to-toe orientation. This support member 56 stabilizes each segment against lateral displacement, which would otherwise occur under the forces applied by the ramps 33 in the illustrated figures. It should therefore be apparent that the segment adjustment member 30 is disposed between the support member 56 and the aligned base segments 21 and is designed to reciprocate within a cavity or track therebetween.

Numerous means are available to attach the segment stud 55 to the support member 56. An example of such attachment means includes a rivet illustrated by item 57. As viewed in FIG. 4, it is apparent that this support member 56 forms an encasement to stabilize the segments against lateral displacement (i.e. from left to right in the drawing). These segments could likewise be attached by means of adhesive, screws, etc. Furthermore, although the drawings illustrate two lateral points of attachment for each segment, other arrangements may work equally well. For example, a single point of attachment could be structured along the central axis of the ski base, with a segment adjustment member including displacement faces which track along each side of the point of attachment. In like manner, a tongue-in-groove arrangement is envisioned wherein the displacement face includes planar and ramp sections which travel along track grooves projecting from the support member and interfacing between grooves of the segment adjustment member. It will be apparent to those skilled in the art that numerous configurations are available to improve stability of the segment adjustment member and/or the respective segments.

The disposition of the displacement face 31 between the respective mounting studs 55 is more clearly illustrated in FIG. 4. Although this cross-section does not illustrate the actual contact between the displacement face 31 and the segment 21, it should be realized that as the segment adjustment member 30 is reciprocated out of the page, the displacement face 31 will eventually contact the displacement contact face 26, resulting in projection of the segment into a stepped-base grip configuration.

Figure 5:
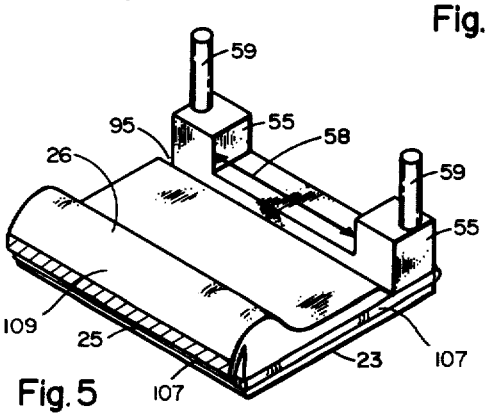
FIG. 5 is a perspective view of a single, isolated base segment.

FIG. 5 isolates an embodiment of the base segment utilized in FIGS. 2–4. As illustrated therein, the mounting stud 55 defines a channel 58 which permits traverse of the displacement face 31 therethrough. For example, if such a channel were not provided, the ramp 33 would be unable to be advanced toward the displacement contact face 26. Rivet means 59 are also disclosed and can be preformed with each segment to facilitate ease of manufacture in fabricating the waxless ski base outlined herein.

FIG. 5 includes a perspective view of the contiguous gripping face 25 which is illustrated to be in an approximate vertical orientation with respect to the glide face 23. This vertical orientation is not critical, however, since the primary function of the gripping face is to enhance traction by developing a "digging" edge which captures part of the snow surface to thereby decrease the speed or even prevent movement in that direction. It should be understood, therefore, that the phrase "approximate vertical orientation" is a very general reference to structure which implements this aspect of implementing the necessary form of traction to facilitate cross-country skiing.

Figure 9:
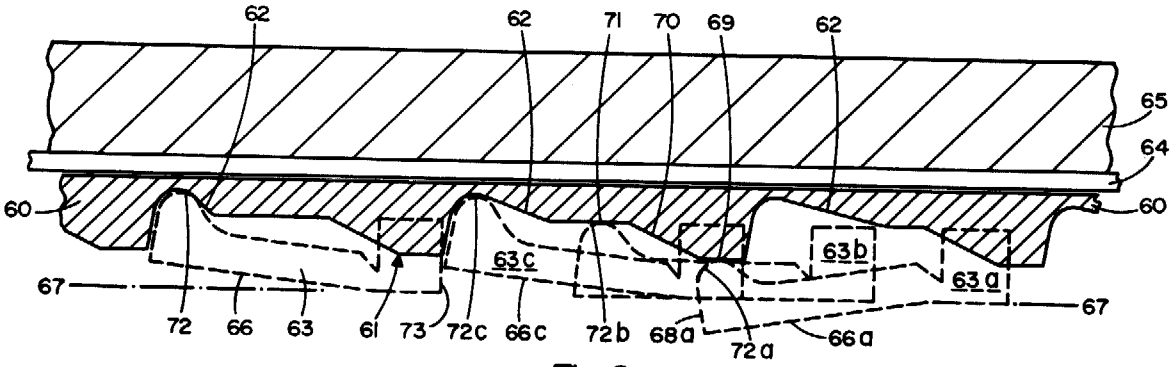
FIG. 9 is a graphic representation of a base segment subject to positive, null and negative displacement.
Figure 10:
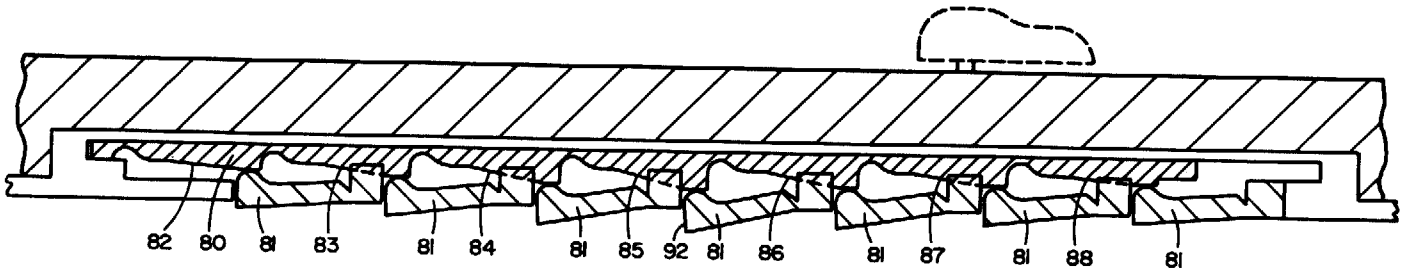
FIG. 10 illustrates a waxless ski base capable of adjustment to either positive or negative displacement, with the base segments positioned at maximum positive displacement.
Figure 11:
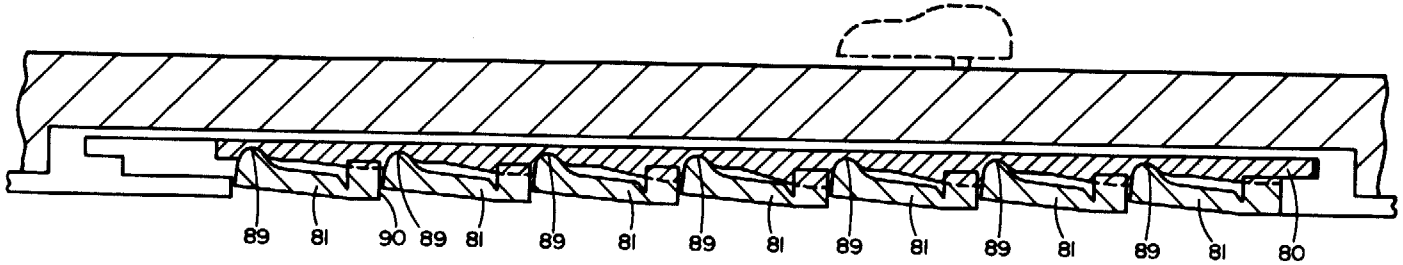
FIG. 11 graphically represents a waxless ski base having both positive and negative adjustment capability, wherein the base segments are fully recessed to maximize traction in the forward direction.

In addition to the positive displacement of segments as illustrated in FIGS. 7 and 8, the present invention contemplates means for developing a negative displacement of the respective base segments to develop resistance to travel and improve traction in a forward direction. Such a configuration may be desirable to reduce speed in a downhill movement, particularly for steeper terrain and unstable conditions. Such negative displacement is developed by a programmed geometric configuration for the displacement face as illustrated in FIGS. 9, 10 and 11. As demonstrated in FIG. 9, the segment adjustment member 60 includes a displacement face 61 which has a recessed section 62 adapted in configuration and location to receive a portion of the segment contact face. As used herein, "recess" refers to the portion of the displacement face whose distance from the baseline 67 exceeds the distance from the segment contact face 72 to the segment glide face 66.

A combination of positive, flat base and negative displacement is illustrated in FIG. 9, wherein the segment 63 is shown in phantom line. In the embodiment illustrated in FIG. 9, the reciprocating structure of the invention may be either the segments 63 or the segment adjustment member 60. If the segments are the reciprocating elements, the segment adjustment member may be considered fixed with respect to the support member 64 and attached ski structure 65. A single traversing segment 63 is illustrated to facilitate an understanding of the combined positive, null and negative displacement which is developed under the programmed geometry of the displacement face 61.

Segment **63*a* is illustrated at the right side of the drawing in a fully extended position, with the glide face 66*a* inclined against the forward direction of travel. It should be noted that in this configuration, some resistance is given against forward movement; however, this flat structure functions primarily as a glide face. The displacement of glide face 66*a* is considered positive in view of its projecting relationship from a base line 67 which represents the glide path of the skier, as well as the flat-base glide configuration. The grip face 68*a* operates to impede rearward motion of the skier and provides the traction or grip desired to climb a hill and/or move forward across relatively flat terrain. This positive displacement is developed because of the extended projection of the displacement face 69 away from the support member 64**. This displacement face is illustrated as a planar section; however, other geometric configurations could be applied. The advantage of the planar section is an improved stability of segment contact.

FIG. 9 also illustrates the position of segment 63 in contact with the flat-base planar face 71 under the numeral reference **63*b*. Such displacement action might occur by adjustment of the base segments in a rearward direction, allowing the segment contact face 72*b* to track along the ramp 70 to the flat-base planar face 71. In this position, the segment is appropriately aligned in the flat-base slide configuration which offers minimal resistance against the snow. This position would be referred to as zero displacement with respect to the base line 67**.

As the segment 63 is urged into a further rearward position, its displacement is characterized by phantom line segment **63*c*. Based on the reference frame of the base line 67, the displacement of segment 63*c* is a negative displacement into the recess 62 as previously described. In this negative displaced position, the glide face 66*c* is now recessed into the segment adjustment member, exposing a second gripping face 73 which now applies resistance toward the forward direction. It is also apparent to those skilled in the art that any number of negative displacement face geometries 62** may be applied to facilitate any number of negative segment displacements.

FIGS. 10 and 11 illustrate a waxless ski base having both positive, null and negative displacement capability. The segment adjustment member 80 in FIG. 10 is displaced fully to the left, causing maximum positive displacement of the segments 81. In this case, the geometry of the respective displacement faces 82–88 have been structured to develop a convex pattern of displacement, with the central segments being more fully displaced than the lateral segments.

With the segment adjustment member 80 displaced to the full opposite position, the segments 81 now fall into the respective recesses 89 or negative displacement faces which expose the second grip face 90 of each respective segment. This is in contrast to the exposure of the first grip face 92 and similar first grip faces of the respective segments 81 in FIG. 10.

In view of the positive, null and negative displacement aspects of the present invention, it should be even more apparent that numerous combinations of geometric configurations can be applied to realize the inventive concepts outlined herein. For example, it has been noted that the ramp configurations disclosed in the figures can be varied in angle of inclination and ramp lengths to develop greater displacement of the segment in one area of the ski base than in another. Generally, the preferred displacement will be realized where the angles of inclination are structured to cause less segment displacement toward the respective ends of the ski base, as compared to greater inclination, in the central portion of the ski base. Furthermore, these ramp configurations can be planar or nonplanar. Additional flat planar sections can be added along the ramp location to provide stable platforms for the segments in either positive, zero or negative displacement.

All of these various displacement patterns are facilitated by the pivotal rotation of a portion of the segment with respect to the support member. This is accomplished by pivotal attachment means as disclosed in FIGS. 3 and 5 as a groove 95 formed into a top portion of the segment and adjacent the means for attachment 55. This groove has sufficient depth to permit positive or negative rotational movement of the opposing segment end having the contact face 26. This rotational movement is about an axis formed at the groove 95 and requires some elasticity in the material forming the segment. It will be apparent to those skilled in the art that other means for developing rotational movement could be implemented within each segment. Such means might include hinge structure or similar implementing means.

Figures 12, 12A, 12B, 12C:
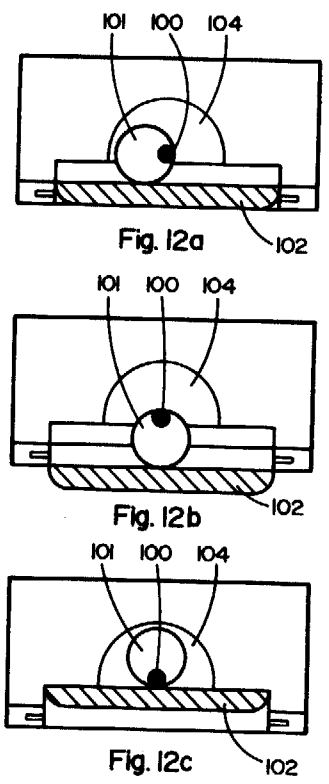
FIGS. 12*a*, 12*b*, and 12*c* illustrate a cam-like adjustment of the base segments, as a variation from the reciprocating structure of the previous figures.

In addition to the alternative forms of geometric configuration and other structure outlined previously, it should be noted that the segment adjustment member does not necessarily have to have a reciprocating path. For example, FIG. 12 illustrates the use of a rotating cam structure which is capable of imposing a programmed geometric configuration with variable adjustment positions against the respective displacement contact faces of the segments. Such structure is illustrated graphically in this figure and includes a rotating cam rod 100 and attached cam wheel 101.

As noted in the figure, the rotation of the cam rod and attached cam wheel displaces the base segment 102 from a flat-base configuration of FIG. 12*a* to a fully displaced position of FIG. 12*b*, and optionally to a recessed position in negative displacement as shown in FIG. 12*c*. As with the previously referenced traversing segment adjustment member, the cam adjustment member operates within a cavity 104 which may be formed within the ski base or ski structure, depending upon whether the referenced waxless ski base is a separate structure or is integrally formed as part of a ski.

In addition to these operational characteristics in structure, a moisture barrier 107 (FIG. 3) may be desirable to prevent water and other foreign matter from obtaining access into the inner core 108 of the ski base assembly. This element may be a flexible barrier or other device which prevents water from seeping through the segments into the core 108. This moisture barrier 107 is disposed at the junction between each respective aligned base segment and at each side thereof to form a circumscribing barrier around the segments. Such structure helps to prevent ice formation within the core which might hinder adjustment of the segment adjustment member.

Also disclosed in FIG. 3 is a membrane attachment 109 which operates to tie the respective segments into a continuous structure to help maintain alignment and to further prevent water infiltration into the core 108. This membrane attachment 109 can be formed as part of an integral segment chain having a length conforming to the desired length of the kicking zone or waist section.

The preferred method of manufacture of the various components of the waxless ski base would be by injection molding of high strength plastics. Numerous thermoplastics having the necessary tensile strength and elasticity are available within the industry. Likewise, these parts could be molded of metal or fiber/resin composites of thermosetting or thermoplastic resins and glass fibers. This is particularly true of the continuous base edge section 20. It should also be apparent that manufacture of the subject waxless ski base may also include items conventionally applied to ski structure such as metal or hardened edges at the extreme sides of the continuous base section, as well as color and graphic coding for ski sizing and use.

As indicated previously, the ski base may be manufactured as either a separate item or as an integral part of a ski. Where it is a separate item, the support member 56 (FIG. 4) would include means 106 for mounting the base to an existing ski base. It such use, the extreme ends of the waxless ski base would naturally be tapered to develop an acceptable base surface. Alternatively, a ski could be manufactured having a recessed housing specifically structured with means to attach any one of an assortment of waxless ski base structures, depending on the type of displacement pattern required. Such versatility would be valuable to adapt a single pair of skis to a variety of skiing conditions, terrain, grade, ski function, skier ability or any other characteristic that may influence ski performance.

FIG. 6 illustrates an exemplary method of a removable or permanent attachment of the waxless ski base to an adjacent waxable and/or waxless ski base surface. This includes a ski base 110 having forward and rearward base sections 44 adapted for gliding over a snow surface. Locking tabs 113 and 114 are formed at intermediate terminal sections 115 and 116 of the respective forward and rearward base sections. The waxless ski base would be adapted for insertion into the ski structure as the bridging waist section of a continuous base surface.

Such structure would enable the skier to adapt a single pair of skis to a variety of circumstances. In deep unbroken snow conditions, for example, a waxless base having a full sawtooth displacement pattern could be inserted for maximum traction. Where snow conditions are prepared and hard-packed, a moderate convex projection may be desirable.

It will be apparent to those skilled in the art that other variations and additional structure may be applied to realize the concepts of invention disclosed herein. Naturally, such structure will vary somewhat where the ski base is a separate item of manufacture to be attached to a core embodiment such as a ski, snowshoe, sled runner, toboggan base or other form of snow travel.

I claim:

1. A waxless ski base capable of continuous adjustment from a flat-base glide configuration to a stepped-base grip configuration for increased traction and resistance to movement over a snow surface, comprising:

a. a elongated support member;

b. a plurality of base segments, each segment having a planar glide face, a contiguous gripping face in approximate vertical orientation with respect to said glide face and a displacement contact face opposite said glide face, said segments being coupled and aligned along a bottom face of the support member such that each glide face is oriented away from the bottom face of said support member and forms part of a flat base when in a glide configuration, said gripping face being oriented along a direction of desired resistance to facilitate a gripping contact with said snow surface when said segments are adjusted to the stepped-base grip configuration;

c. means for independent pivotal attachment of each base segment to said support member;

d. a segment adjustment member disposed between the support member and said aligned base segments, said adjustment member including a plurality of displacement faces which have differing programmed geometric configurations which respectively contact said segment displacement contact faces and mutually cooperate to displace said segments from the flat-base glide configuration to a nonlinear stepped configuration; and e. means for selectively changing the location of contact of said segment contact faces along the respective programmed geometric configurations of the segment displacement faces.

2. A waxless ski base as defined in claim 1, wherein said non-linear stepped configuration comprises a segment displacement pattern wherein the distal edge of each segment forms part of a convex arc projecting away from the support member.

3. A waxless ski base as defined in claim 1, wherein said programmed geometric configurations have a structure whose contact and resultant displacement pattern includes a flat-base glide configuration, a nonlinear stepped configuration and a fully extended sawtooth configuration.

4. A waxless ski base as defined in claim 1 wherein the programmed geometric configuration of at least one displacement face of the segment adjustment member includes a recessed configuration adapted in size and location to receive a portion of a correspondingly oriented segment contact face to enable a negative displacement of the segment and its component glide face toward the support member, and wherein the segment subject to the negative displacement immediately follows a second segment which includes a second gripping face contiguous thereto and adapted for exposure in a forward direction by said negative displacement.

5. A waxless ski base as defined in claim 1 wherein said programmed geometric configurations include structure whose contact and resultant displacement pattern of segments includes selection of a flat-base glide configuration, a non-linear stepped configuration, a fully extended saw-tooth configuration and a negatively displaced stepped configuration.

6. A waxless ski base as defined in claim 1, wherein said segment adjustment member comprises an elongated rigid structure and means to reciprocate said structure with respect to said segment contact faces to cause displacement thereof in response to said programmed geometric configurations.

7. A waxless ski base as defined in claim 6 wherein said displacement faces include a plurality of ramp configurations having differing angles of inclination and lengths.

8. A waxless ski base as defined in claim 7 wherein the respective angles of inclination are substantially equal toward the respective ends of the ski base as compared to differing angles of inclination toward the central portion of said ski base.

9. A waxless ski base as defined in claim 6 wherein said programmed geometric configuration includes a flat, planar section whose relative movement does not affect any displacement of said base segment in contact therewith.

10. A waxless ski base as defined in claim 9 wherein said programmed geometric configurations respectively include a flat-base planar section and a ramp section, together providing a single track as part of one of the displacement faces of the segment adjustment member.

11. A waxless ski base as defined in claim 10, wherein the flat planar and ramp sections of at least two tracks have differing dimensions which cause differential displacement of the respective base segments in contact therewith.

12. A waxless ski base as defined in claim 11 wherein the planar sections of each respective track increase in surface area as the proximity of said track is more closely oriented toward a center part of the ski base.

13. A waxless ski base as defined in claim 10, wherein said ramps include an intermediate flat, planar section to provide a stable adjustment location between the flat-base glide configuration and a fully extended stepped configuration.

14. A waxless ski base as defined in claim 10, wherein said flat planar section is intermediate of a ramp section on one side and a recessed cavity on the other side to provide full adjustment from a negative displacement configuration, through a flat-base glide configuration to a stepped-base grip configuration.

15. A waxless ski base as defined in claim 7 wherein said ramps are non-planar in configuration.

16. A waxless ski base as defined in claim 15 wherein at least one of said non-planar ramps is formed with a convex contacting surface.

17. A waxless ski base as defined in claim 1, wherein said elongated support member includes means for attachment to a ski.

18. A waxless ski base as defined in claim 1, wherein said base segments comprise at least one projecting stud at one end of the segment as said means for independent pivotal attachment, the other end of the segment comprising an upward projecting lip which operates as said displacement contact face, said gripping face forming a side portion of the segment between said flat base and said displacement contact face lip.

19. A waxless ski base as defined in claim 18, wherein said segment includes a groove formed into a portion of the segment and adjacent the means for attachment of each segment to the support member, said groove being sufficiently recessed into the segment to permit rotational movement of the opposing segment end about an axis formed at said groove.

20. A waxless ski base as defined in claim 18, wherein said pivotal attachment means are oriented toward a forward direction on said ski base and said displacement contact face lips are oriented in a rearward direction in heel-to-toe alignment.

21. A waxless ski base as defined in claim 20 wherein said base segments further comprise an attached membrane between each respective base segment and its contiguous segments.

22. A waxless ski base as defined in claim 21, further comprising a moisture barrier disposed at the junction between each respective aligned base segment and each side thereof to prevent moisture penetration into a core section of the ski base.

23. A waxless ski base as defined in claim 1, wherein said segment adjustment member comprises a rotatable cam means having respective cam faces which operate against the displacement contact faces of the respective base segments to develop a differing pattern of geometric projection of said base segments in contact therewith.

24. A waxless ski base as defined in claim 1, wherein said means for selectively changing contact location of the segment displacement faces comprises a gear mechanism including means to develop transverse reciprocation of said segment adjustment member.

25. A waxless ski base as defined in claim 24 wherein said gear mechanism includes an adjustment knob projecting upward at the top of said ski base to facilitate adjustment by a skier during actual use.

26. A waxless ski base as defined in claim 1 which is formed as an integral part of a cross-country ski.

27. A waxless ski base as defined in claim 1 which is formed as a non-integral part of a cross-country ski with means for releasable attachment therebetween.

28. A waxless ski base as defined in claim 1, further comprising means for attachment of the ski base to a core embodiment.

29. A waxless ski base as defined in claim 1, wherein the means for selectively changing the location of contact of the segment contact faces and segment displacement faces include means for reciprocating the segment adjustment member between forward and rearward positions.

30. A waxless ski base as defined in claim 1 includes means for reciprocating the aligned segments between forward and rearward positions.

31. A waxless ski base as defined in claim 1 includes cam adjustment means comprising a cam rod and attached cam wheel which operates against the segment contact faces to develop a desired displacement pattern.

32. A waxless ski base as defined in claim 1, wherein said segment adjustment member is a removable component of the ski base to permit rapid change from one displacement face geometry to another different geometry.

* * * * *